United States Patent [19]

Lyons

[11] 4,005,586

[45] Feb. 1, 1977

[54] REFRIGERATED BUTTER DISH

[76] Inventor: Arthur Lyons, 646 Morongo Road, Palm Springs, Calif. 92262

[22] Filed: Mar. 11, 1976

[21] Appl. No.: 665,909

[52] U.S. Cl. ..... 62/372; 62/457; 62/459

[51] Int. Cl.[2] ..... F25D 3/08; F25D 3/02

[58] Field of Search ..... 62/371, 372, 457, 530, 62/529, 458, 459, 463, 464

[56] References Cited

UNITED STATES PATENTS

| | | | |
|---|---|---|---|
| 1,731,604 | 10/1929 | Allen | 62/457 |
| 3,240,030 | 3/1966 | Peters et al. | 62/459 |
| 3,703,088 | 11/1972 | Moorhead | 62/459 |

*Primary Examiner*—Lloyd L. King
*Attorney, Agent, or Firm*—James E. Brunton

[57] ABSTRACT

A refrigerated butter dispenser comprising a receptacle for containing crushed ice and an invertable cover unit which has on one side thereof a handle for lifting the cover and on the other an outwardly extending tapered skirt defining interiorly thereof a butter receiving chamber. When the dispenser is not being used, the cover is positioned so that the skirt portion depends inwardly of the receptacle, keeping the butter contained therein in close proximity with the crushed ice. When it is desired to remove the butter from the dispenser, the cover is inverted so that the skirt portion extends upwardly, making the butter chamber readily accessible to the user.

7 Claims, 5 Drawing Figures

REFRIGERATED BUTTER DISH

BACKGROUND OF THE INVENTION

1. Field of the Invention

The present invention relates generally to food dispensing apparatus and containers and more particularly, to a novel refrigerated butter dispenser wherein table servings of butter can be maintained at low temperature until ready for consumption.

2. Discussion of the Prior Art

Table service of individual portions of butter, particularly in large-scale restaurant operations, has long presented nagging problems. Unlike condiments such as sugar, salt, pepper, mustard, ketchup, and the like, which do not require refrigeration, butter must be kept cold until it is ready to be used by the diner. Particularly troublesome is the fact that while most condiments can be conveniently stored in standard dispensing containers which may be placed on the table when the table is initially set, butter must either be specially brought to the table after the patrons are seated, or it must be served in special dispensers.

So that butter may be placed on the table as part of the normal "set-up" by the busboy, restaurants typically resort to the unsightly and unsatisfactory expedient of placing small patties or scoops of butter on a bed of crushed ice disposed in shallow bowls or similar serving dishes. Serving the butter in this manner is objectionable for several reasons. In the first place, the method of service is unsanitary since the butter is exposed to room atmosphere for a considerable period of time while the restaurant patrons are being seated and served. Additionally, this expedient has proven to be messy and inconvenient both for the restauranteur and the patron. If the butter dish is placed on the table prematurely, the ice will melt, causing the butter to soften and become covered with water, thereby necessitating its replacement by the waiter. Also, because removal of the butter from the bed of ice is quite cumbersome, spills frequently occur, causing embarrassment and inconvenience.

The novel butter dispenser of the present invention provides a unique solution to the problem of serving butter both at home and in restaurants. As will become apparent from the discussion which follows, the dispenser of the present invention allows small quantities of butter to be served graciously, efficiently and in a sanitary manner. Because of the unique design of the dispenser, it can be filled and placed on the table well in advance of serving the meal. Until it is ready to be used, the butter is effectively maintained at a low temperature in a sanitary, closed container. Being in a separate chamber, the butter will not become contaminated with water from the melting ice. When it is desired to use the butter, the cover of the dispenser is merely inverted and reseated upon the ice container, thereby making the butter chamber easily accessible to the user.

SUMMARY OF THE INVENTION

It is an object of the present invention to provide a unique refrigerated butter dispenser for use in restaurants and homes in which small servings of butter in whipped or other moldable form can be conveniently placed on the dining table and maintained at low temperature and under sanitary conditions until ready for use.

More specifically, it is an object of the invention to provide a dispenser of the aforementioned character which consists of an attractively styled receptacle for containing crushed ice and a cooperating cover unit having formed on one side thereof a handle and on the other a skirt portion defining a butter receiving chamber adapted to be telescopically received within the receptacle.

When the dispenser is not being used, the cover unit is placed on the receptacle with the butter chamber depending inwardly so as to locate the butter in close proximity with the crushed ice. In this configuration, the dispenser has the appearance of an attractively styled sugar bowl or the like. When it is desired to remove the butter from the dispenser, the cover is inverted and reseated on the base receptacle so that the butter chamber protrudes upwardly, enabling easy removal of the butter from the open ended chamber with a butter knife or the like.

It is another object of the invention to provide a butter dispenser suitable for use in restaurant operations in which the individual servings of butter can be kept cold for reasonably long periods of times so that butter can be placed into the dispenser at the time the table is set by the busboy and will remain cold until the restaurant patron can be seated, served and is ready to use the butter.

It is a further object to provide a dispenser as described in the preceding paragraph which is highly attractive, making it suitable for use in fine restaurants, but at the same time, is durable and easy to use.

It is still another object of the invention to provide a dispenser as previously described which can be manufactured inexpensively from a wide variety of materials, including ceramics, plastics, and metal.

In summary, these and other objects of the invention are realized by a butter dispenser comprising a cover unit and a first generally cylindrically shaped receptacle adapted to contain crushed ice having side walls terminating in an upper annular rim portion defining an open upper end and a generally circular bottom wall formed integrally with the side walls for closing the lower end of the first receptacle. The cover unit comprises a generally disc-shaped flange portion having first and second sides adapted to engage the upper annular rim portion of the first receptacle. Extending from the first side of the flange portion is a generally frustoconically shaped skirt defining a second receptacle adapted to be telescopically received within the open upper end of the first receptacle. A handle extends from the second side of the flange portion for lifting the cover, the handle being receivable within the open upper end of the first receptacle. Engagement means are provided on the second side of the flange portion for positionable engagement with the annular rim portion of the first receptacle.

DESCRIPTION OF THE PREFERRED EMBODIMENT

Figure 1:
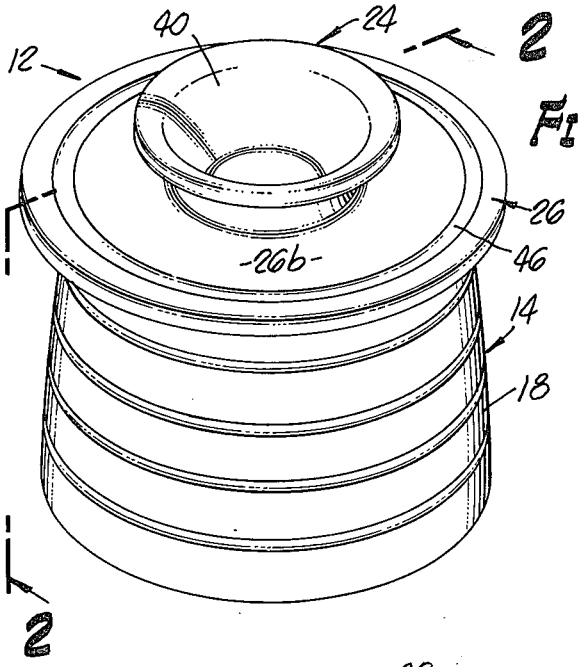
FIG. 1 is a perspective view of the refrigerated butter dispenser of the present invention showing the appearance of the device in the butter refrigeration mode.
Figure 2:
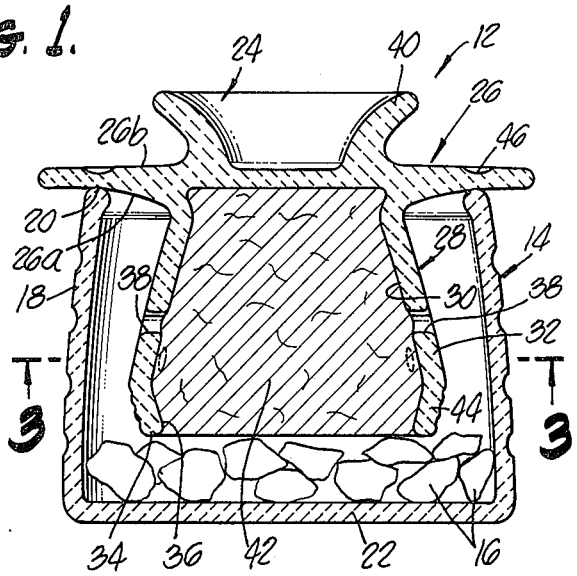
FIG. 2 is a cross-sectional view taken along lines 2—2 of FIG. 1.
Figure 3:
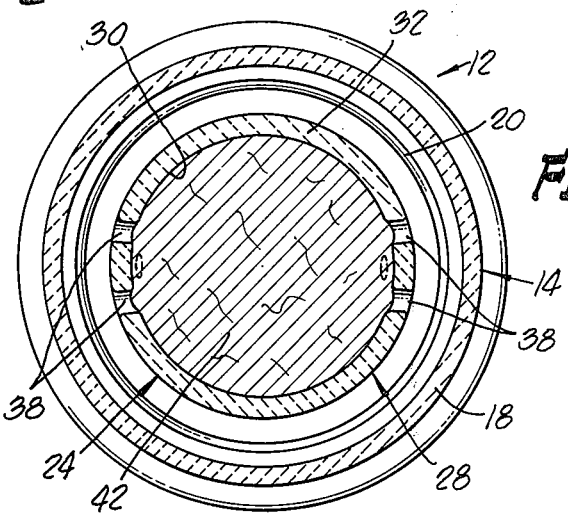
FIG. 3 is a cross-sectional view taken along lines 3—3 of FIG. 2.

Referring to the drawings and particularly to FIGS. 1–3, the refrigerated butter dispenser of the present invention, generally designated by the numeral 12, is shown in the refrigeration mode. As best seen in FIGS. 2 and 3, the dispenser of this form of the invention comprises a generally cupshaped first receptacle 14 adapted to contain crushed ice, designated in the drawings by the numeral 16. First receptacle 14 has slightly inwardly tapering side walls 18 terminating in an upper annular rim 20. A generally circular bottom wall 22 formed integrally with side walls 18 closes the lower end of the receptacle.

Figure 4:
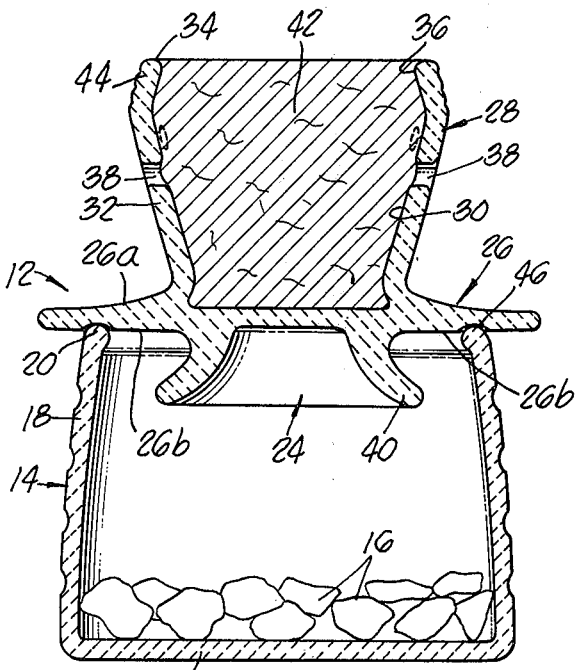
FIG. 4 is a side elevational cross-sectional view of the refrigerated butter dispenser of the invention showing the appearance of the unit in the butter dispensing mode with the cover unit inverted so that the butter chamber is accessible to the user.
Figure 5:
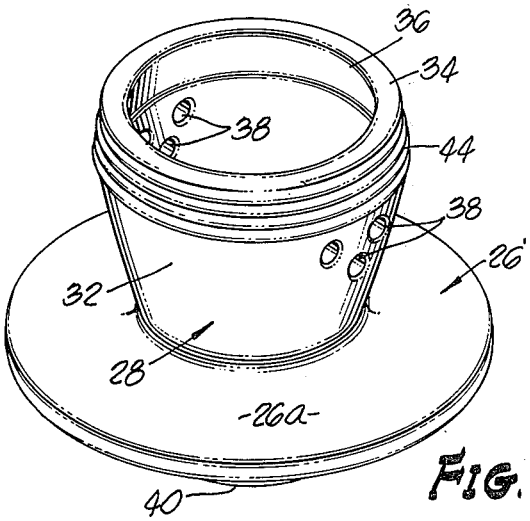
FIG. 5 is a perspective view of the cover portion of the dispenser showing the configuration of the butter receiving chamber of the unit.

The second part of the butter dispenser of this form of the invention consists of a cover 24 including a generally disc-shaped flange 26. As shown in FIG. 2, flange 26 has first and second sides **26*a* and 26*b* adapted to engage the upper annular rim portion 20 of first receptacle 14. With the butter dispenser in the refrigeration mode as illustrated in FIG. 2, first side 26*a* of flange 26 is in engagement with the annular rim 20. With the butter dispenser in the dispensing mode, as shown in FIG. 4, second side 26*b* of flange 26 is in engagement with annular rim 20. Extending from first side 26*a* of flange 26 is a generally frustoconically shaped skirt 28 defining a second generally cup-shaped receptacle or butter receiving chamber 30. As best seen in FIG. 5, side walls 32 of skirt 28 slope outwardly from the first side of flange 26 and terminate in an annular rim 34 defining an open outer end 36. As illustrated in FIG. 2, skirt 28 is adapted to be telescopically received within the open upper end of first receptacle 14 when the unit is in its refrigeration or butter storage mode. To permit cool air from receptacle 14 to reach the butter packed within the butter chamber 30, a plurality of ventilation apertures 38 are formed in walls 32 of skirt 28 intermediate the ends thereof. In a manner presently to be described, apertures 38** also assist in holding the butter within the butter receiving chamber of the device when in its refrigeration mode.

Extending from second side **26*b* of flange 26 is a substantially circular handle 40 for lifting the cover. As illustrated in FIG. 4, handle 40 is of a diameter as to be receivable within the open upper end of first receptacle 14** when the unit is in the butter dispensing mode shown in FIG. 4.

The dispenser of the present invention can be constructed from a wide variety of materials including ceramics, moldable plastics, metal, or a wide variety of composite materials. Using any of these materials, a gracious, highly attractive unit can be constructed in various designs, making it suitable for table setting in even the finest of restaurants.

In using the butter dispenser of the present invention, the crushed ice 16 is first placed in the bottom of first receptacle 14. Holding cover 24 by means of handle 40, butter 42 in whipped or other moldable form is packed by means of a spatula or the like into butter receiving chamber 30. The cover is then placed onto receptacle 14 so that skirt 28 depends into receptacle 14 in the manner shown in FIG. 2. As illustrated in FIGS. 2 and 4, side walls 32 of skirt 28 are flared inwardly proximate their open outer end. This inwardly flared wall section, indicated in the drawings by the numeral 44, assists in holding the butter within chamber 30. Apertures 38 in walls 32 also serve to assist in holding the butter within the butter chamber.

With the device in the refrigeration mode described in the preceding paragraph, it can be placed on the dining table at the time the table is set with dishes, silverware, and condiments. Because of the unique design of the dispenser, the butter contained within chamber 30 will remain cold for a substantial period of time, thereby allowing the diner to be seated and served. When it is desired to remove butter from the dispenser, the diner simply inverts cover 24 so that second surface **26*b* of flange 26 rests upon annular rim 20 of receptacle 14. To prevent the cover portion from shifting relative to receptacle 14 during removal of the butter from chamber 30, engagement means are formed on side 26*b* of flange 26 for positionable engagement with annular rim 20. In the embodiment of the invention shown in the drawings, the engagement means is provided in the form of a generally circular groove 46 (FIG. 4) formed in side 26*b* of flange 26. Circular groove 46 is adapted to closely receive annular rim 20 of receptacle 14 so as to prevent lateral shifting of the cover 24** with respect thereto.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A refrigerated butter dispenser comprising:

a. a first receptacle adapted to contain crushed ice having:
   1. side walls terminating in an upper rim portion defining an open upper end; and
   2. a bottom wall formed integrally with said side walls for closing the lower end of said first receptacle; and b. a cover comprising:
   1. a flange portion having first and second sides adapted to engage said upper rim portion of said first receptacle;
   2. a skirt extending from said first side of said flange portion defining a second receptacle adapted to be telescopically received within the open upper end of said first receptacle; and
   3. a handle extending from said second side of said flange portion for lifting the cover, said handle being receivable within the open upper end of said first receptacle.

2. A refrigerated butter dispenser as defined in claim 1 in which said skirt is generally frustoconically shaped having walls sloping outwardly from said flange portion and terminating in an annular rim defining an open outer end.

3. A refrigerated butter dispenser as defined in claim 2 in which said walls of said skirt are flared inwardly proximate their open outer end.

4. A refrigerated butter dispenser as defined in claim 3 in which said walls of said skirt are provided with a plurality of ventilation apertures intermediate the ends thereof for enhancing the refrigeration of the butter contained within said second receptacle.

5. A refrigerated butter dispenser as defined in claim 1 including engagement means formed on said second side of said flange for positionable engagement with said upper rim portion of said first receptacle.

6. A refrigerated butter dispenser comprising:

a. a first generally cup-shaped receptacle adapted to contain crushed ice having:

1. side walls terminating in an upper annular rim portion defining an open upper end; and
2. a generally circular bottom wall formed integrally with said side walls for closing the lower end of said first receptacle; and b. a cover unit comprising:

1. a generally disc-shaped flange portion having first and second sides adapted to engage said upper annular rim portion of said first receptacle;
2. a generally frustoconically shaped skirt extending from said first side of said flange portion defining a second receptacle adapted to be telescopically received within the open upper end of said first receptacle;
3. a handle extending from said second side of said flange portion for lifting the cover, said handle being receivable within the open upper end of said first receptacle; and
4. engagement means formed on said second side of said flange portion for positionable engagement with said annular rim portion of said first receptacle.

7. A refrigerated butter dispenser as defined in claim 6 in which said engagement means comprises a generally circular groove formed in said second side of said flange portion, said circular groove being adapted to receive said annular rim portion of said first receptacle.

* * * * *